US006442881B1

(12) United States Patent
Kellerman

(10) Patent No.: US 6,442,881 B1
(45) Date of Patent: Sep. 3, 2002

(54) FIREARM BARREL LOCK

(76) Inventor: Donald R. Kellerman, 815 Highway P, O'Fallon, MO (US) 63366

( * ) Notice: Subject to any disclaimer, the term of this patent is extended or adjusted under 35 U.S.C. 154(b) by 0 days.

(21) Appl. No.: 09/681,198

(22) Filed: Feb. 19, 2001

(51) Int. Cl.[7] ..... F41A 17/04; F41A 17/44
(52) U.S. Cl. ..... 42/70.11
(58) Field of Search ..... 42/70.01, 70.11

(56) References Cited

U.S. PATENT DOCUMENTS

| | | | | |
|---|---|---|---|---|
| 2,327,334 A | | 8/1943 | Parker | |
| 2,479,107 A | | 8/1949 | Garretson | |
| 2,763,081 A | | 9/1956 | Huckabee | |
| 2,887,807 A | | 5/1959 | Santangelo | |
| 3,022,598 A | | 2/1962 | Wikstrom | |
| 3,137,957 A | | 6/1964 | Ingalls | |
| 3,564,746 A | | 2/1971 | McConnell | |
| 3,708,901 A | | 1/1973 | Wolter | |
| 3,710,490 A | | 1/1973 | Cornett et al. | |
| 3,720,014 A | | 3/1973 | Goodrich | |
| 4,136,476 A | | 1/1979 | Hetrick | |
| 4,224,753 A | | 9/1980 | Bielman | |
| 4,398,366 A | | 8/1983 | Wernicki | |
| 4,479,320 A | | 10/1984 | Fix | |
| 5,001,854 A | * | 3/1991 | Derman | 42/70.11 |
| 5,038,508 A | | 8/1991 | Brown | 42/70.11 |
| 5,062,233 A | | 11/1991 | Brown | 42/70.11 |
| 5,233,777 A | | 8/1993 | Waterman, Jr. et al. | 42/70.11 |

FOREIGN PATENT DOCUMENTS

| | | | | |
|---|---|---|---|---|
| GB | 2233075 | * | 1/1991 | 42/70.11 |
| WO | 88/06264 | * | 8/1988 | 42/70.11 |
| WO | 92/06345 | * | 4/1992 | 42/70.11 |

* cited by examiner

*Primary Examiner*—Stephen M. Johnson
(74) *Attorney, Agent, or Firm*—Polster, Lieder, Woodruff & Lucchesi

(57) ABSTRACT

A firearm safety lock comprises a chamber insert and a muzzle insert secured together through the barrel of a firearm by an adjustable-length cable connection. The chamber insert is sized to fit within the breech of a firearm, and to prevent the loading of ammunition therein. The chamber insert receives a first end of a flexible cable, which is secured within a central bore of the chamber insert. The flexible cable extends the length of the firearm barrel, and is fitted, at the opposite end, to a lock receiving rod. The lock receiving rod includes at least one circumferential groove, and passes through a central bore in the muzzle insert. The flexible cable length is adjusted such that a portion of the lock receiving rod is retained within the barrel, and a portion extends external thereto. An off-axis transverse bore in the muzzle insert is aligned with the circumferential groove in the lock receiving rod, permitting an armature of a conventional padlock to pass there through, securing the muzzle insert to the lock receiving rod and the chamber insert within the firing chamber, preventing the loading or firing of ammunition.

11 Claims, 4 Drawing Sheets

FIREARM BARREL LOCK

BACKGROUND INVENTION

The present invention related to a firearm safety locking apparatus, and more particularly, to a firearm safety lock employing a chamber insert connected to a muzzle insert which is locked against the exterior surface of the muzzle, thereby preventing the loading of ammunition and subsequent firing of a locked firearm such as a rifle, shotgun, or non-revolver type handgun.

Increased awareness of firearm safety has resulted in the desirability of providing a convenient locking mechanism for firearms, particularly for use during storage in a home where children are present, or during vehicular transportation, as may be required by law. Commonly, a conventional trigger locking mechanisms may be employed to block movement of the firearm trigger mechanism. However, trigger locking mechanisms do not prevent the loading of ammunition into the firing chamber of the firearm, and therefore may not prevent a accidental discharge if the trigger lock is dislodged, or incorrectly installed so as to permit sufficient trigger motion to discharge the firearm.

An alternative firearm locking mechanism, of the type shown in U.S. Pat. No. 5,233,777 to Waterman, Jr. et al. employs a cable which extends from a chamber insert, through a muzzle cap, and is secured to an external lock. The cable firearm locking mechanism disclosed in the "777 Waterman, Jr. et al. patent is adjustable to a variety of firearms only by interchanging differently sized and shaped chamber inserts, and by providing cables of differing lengths. However, the firearm locking mechanism shown in the "777 Waterman, Jr. et al. patent may leave a portion of the cable exposed beyond the muzzle cap if the firearm barrel length is shorter than the cable length, as the muzzle cap is not secured against movement relative to the cable. Such an exposed portion of cable may be easily broken or cut to remove the safety lock.

Accordingly, there is a need for a firearm safety lock which is highly visible, prevents the loading of ammunition into the firearm, is adjustable to provide a high degree of security to a wide variety of firearms including rifles, shotguns, and non-revolver type handguns, and which is tamper resistant.

SUMMARY OF INVENTION

Briefly stated, the firearm safety lock of the present invention comprises a chamber insert and a muzzle insert secured together through the barrel of a firearm by means of an adjustable-length cable connection. The chamber insert is sized to fit within the breech of a firearm, and to prevent the loading of ammunition therein. A central bore in the chamber insert receives a first end of a flexible cable, which is secured within the central bore. The overall length of the firearm safety lock may be adjusted by repositioning the attachment of the first end of the flexible cable within the chamber insert central bore. The flexible cable extends the length of the firearm barrel, and is fitted, at the opposite end, to a cylindrical lock receiving rod. The lock receiving rod includes at least one circumferential groove, and passes through a central bore in the muzzle insert. The flexible cable length is adjusted to remove any slack such that a portion of the lock receiving rod is retained within the barrel, and a portion of the rod extends external thereto. An off-axis transverse bore in the muzzle insert is aligned with a circumferential groove in the lock receiving rod, permitting an armature of a conventional padlock to pass there through, engaging both the muzzle insert and the lock receiving rod, securing the components against movement.

In a first alternate embodiment, a posterior portion of the chamber insert adjacent the firing pin for the firearm contains a recession filled with a pliable material, permitting the firing pin or hammer to be released, or dry fired, thereby removing tension from the firing mechanism springs during storage of the firearm.

In a second alternate embodiment, the first end of the flexible cable is fitted to a second locking rod having at least one circumferential groove. The second locking rod is sized to fit fully within the central bore of the chamber insert. The chamber insert includes at least one off-axis transverse bore intersection a portion of the chamber insert central bore, such that a removable lock pin passing through the off-axis transverse bore engages the circumferential groove of the second locking rod within the chamber insert central bore, thereby securing the flexible cable thereto. The overall length of the firearm safety lock may be adjusted by removing the lock pin, repositioning the second locking rod within the central bore of the chamber insert, and inserting the lock pin back into either the same off-axis transverse bore to engage a different circumferential groove in the second locking rod, or into a different transverse bore to engage either the same or a different circumferential groove in the second locking rod.

The foregoing and other objects, features, and advantages of the invention as well as presently preferred embodiments thereof will become more apparent from the reading of the following description in connection with the accompanying drawings.

BRIEF DESCRIPTION OF DRAWINGS

In the accompanying drawings which form part of the specification.

Corresponding reference numerals indicate corresponding parts throughout the several figures of the drawings.

DETAILED DESCRIPTION

The following detailed description illustrates the invention by way of example and not by way of limitation. The description clearly enables one skilled in the art to make and use the invention, describes several embodiments, adaptations, variations, alternatives, and uses of the invention, including what is presently believed to be the best mode of carrying out the invention.

Figure 1:
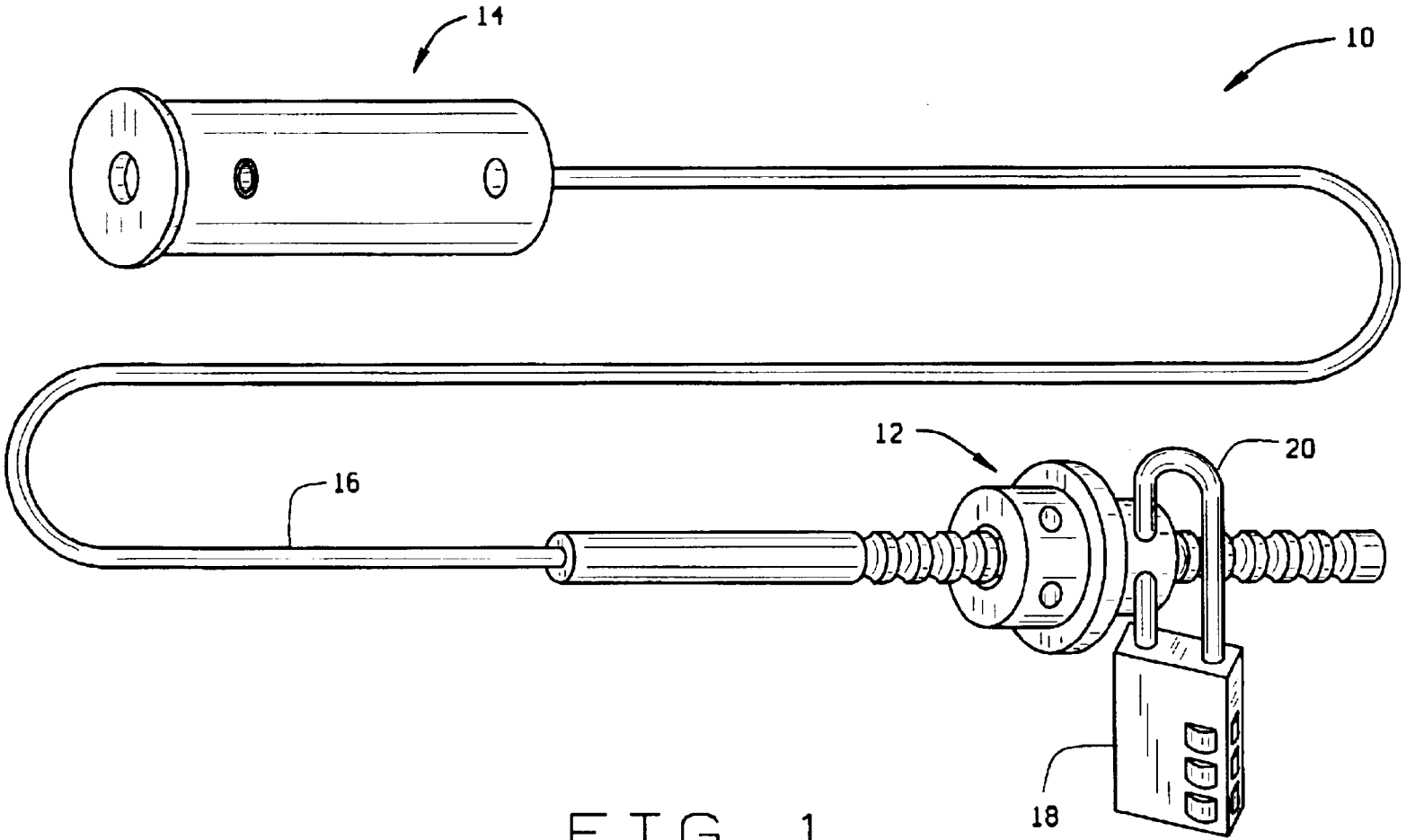
FIG. 1 is a perspective view of an assembled firearm safety lock of the present invention.

Turning to FIG. 1, the components of the firearm safety locking kit 10 of the present invention are shown assembled external to a firearm. The firearm safety locking kit 10 comprises a muzzle insert 12, a chamber insert or cartridge-style insert 14, a length of connecting cable or tensioning member 16, and a conventional lock 18 having an armature 20. The firearm safety locking kit 10 is especially adapted for use in connection with a wide range of firearm makes and models, including rifles, shotguns, and non-revolver type handguns and may be adjusted to compensate for variations in firearm barrel lengths and sizes.

Figure 2:
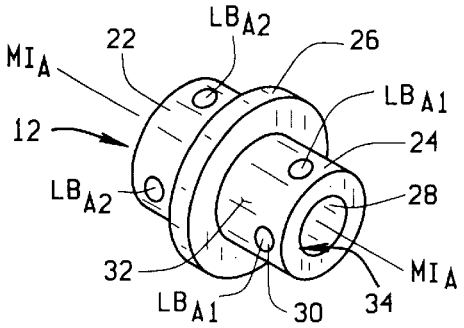
FIG. 2 is a perspective view of a muzzle insert of the present invention.
Figure 3:
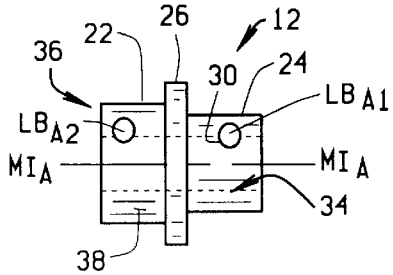
FIG. 3 is a side view of the muzzle insert of FIG. 2.
Figure 4:
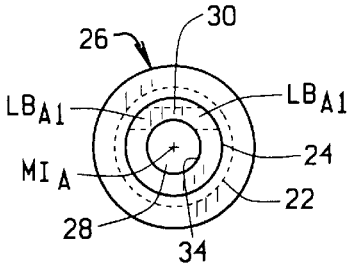
FIG. 4 is an end-view of the muzzle insert of FIG. 2.

Turning to FIGS. 2–4, a first embodiment of the muzzle insert 12 is illustrated. The muzzle insert 12 comprises a first cylindrical portion 22, sized to fit within the barrel of a conventional firearm of a first caliber. A second cylindrical portion 24, optionally sized to fit with the barrel of a conventional firearm of a second caliber, is formed axially opposite the first cylindrical portion 22, defining a longitudinal axis $MI_A$. The first and second cylindrical portions 22 and 24 are separated by a circumferential flange or shoulder 26 having a diameter greater than that of either cylindrical portions. When either cylindrical portion 22 or 24 is seated within the muzzle of a firearm, the circumferential flange 26 engages the face of the muzzle, and prevents the muzzle insert 12 from passing through the muzzle. The muzzle insert 12 further includes a longitudinal axial bore 28 sized to receive the connecting cable 16 and an off-axis transverse lock receiving bore 30 sized to receive the armature 20 of the lock 18 in the second cylindrical portion 24, perpendicular to the longitudinal axis bore 28. The off-axis transverse lock receiving bore 30 forms a chord between two points on the exterior surface 32 of the second cylindrical portion 24, and intersects the longitudinal axial bore 28 such that the axis $LB_{A1}$ of the off-axis transverse lock receiving bore 30 is tangent to the inner surface 34 of the longitudinal axial bore 28. Optionally, a plurality of off-axis transverse lock receiving bores may be longitudinally spaced along the second cylindrical portion 24.

In an alternative embodiment, the second cylindrical portion 24 of the muzzle insert 12 is sized to fit with the barrel of a conventional firearm of a second caliber, and the first cylindrical portion 22 further includes a second off-axis transverse lock receiving bore 36, similarly sized to receive the armature 20 of lock 18. The second off-axis transverse lock receiving bore 36 forms a chord between two points on the exterior surface 38 of the first cylindrical portion 22, and intersects the longitudinal axial bore 28 such that the axis $LB_{A2}$ of the off-axis transverse lock receiving bore 36 is tangent to the inner surface 34 of the longitudinal axial bore 28. Optionally, a plurality of second off-axis transverse lock receiving bores may be longitudinally spaced along the first cylindrical portion 22.

Figure 6:
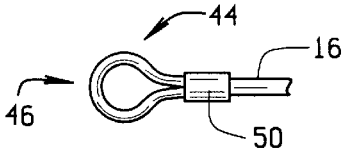
FIG. 6 is a view of the second end of the cable of FIG. 5, illustrating a crimped loop.
Figure 5:
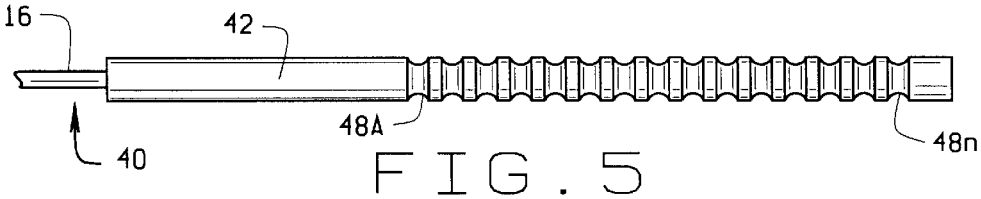
FIG. 5 is a side view of a first cylindrical locking rod of the present invention affixed to a first end of a cable.

Turning next to FIGS. 5 and 6, the connecting cable or tensioning member 16 is shown with a first end 40 secured to a cylindrical locking rod 42, and a second end 44 formed into a crimped loop 46. The connecting cable 16 is preferably formed from a conventional multi-strand stainless steel wire of sufficient strength to resist breakage and cutting, but may optionally be formed from other materials, including single-strand wire or polymer materials having suitable properties. The first end 40 of the connecting cable is secured to the base of the cylindrical locking rod 42. The cylindrical locking rod 42 is formed from a rigid material, preferably steel, has an out diameter sized to fit within the longitudinal axis bore 28 of the muzzle insert 12, and includes at least one circumferential groove 48*a.* The circumferential groove 48*a* presents a hemispherical cross-section, and has the same radius as the off-axis transverse lock receiving bore 30. Optionally, a plurality of identically formed and equidistantly spaced circumferential grooves 48*a*–48*n,* where n is intended to designate any suitable number, depending upon the length of the rod 42, may be spaced longitudinally about the cylindrical locking rod 42. The longitudinal length of the cylindrical locking rod 42 is preferably between 3.0 and 5.0 inches, with a total of 15 circumferential grooves 48*a.* Those of ordinary skill in the art will recognized that the specific dimensions of the cylindrical locking rod 42, and the number n and spacing of the circumferential grooves 48*a* may be varied, depending upon the type and dimensions of the firearm for which the firearm safety lock kit 10 is configured for use.

As seen in FIG. 6, the second end 44 of the connecting cable 16 is preferably formed into a conventional crimped loop 46. The crimped loop 46 may be formed by crimping the second end 44 of the connecting cable 16 in parallel with itself using a conventional metal crimp 50, or in the second end 44 may be woven back into the connecting cable 16, forming an integral loop (not shown). Those of ordinary skill in art will recognize that a variety of loops and crimps may be formed at the second end 44 of the connecting cable 16, including, but not limited to, the attachment of the connecting cable to a pre-formed metal hoop, or an integrally formed opening in a polymer cable.

Figure 7:
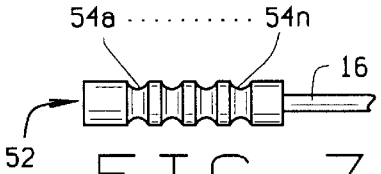
FIG. 7 is an view of an alternate embodiment of the second end of the cable of FIG. 5, illustrating a second cylindrical locking rod.

In an alternative embodiment shown in FIG. 7, the second end 44 of the connecting cable 16 is secured to the base of a second cylindrical locking rod 52. The second locking rod 52 is formed from a rigid material, preferably steel, has an out diameter sized to engage the chamber insert 14, as will be described below in more detail, and includes at least one circumferential groove 54*a.* The circumferential groove 54*a* is formed to the same dimensions as the circumferential groove 48*a* in the first cylindrical locking rod 42. Optionally, a plurality of identically formed and equidistantly spaced circumferential grooves 54*a*–54*n* where n is intended to designate any suitable number, depending upon the length of the rod 52, may be spaced longitudinally about the second locking rod 52. The longitudinal length of the second locking rod 52 is sized to fit within the chamber insert 14, as will be described below in more detail. Those of ordinary skill in the art will recognized that the specific dimensions of the second locking rod 52, and the number n and spacing of the circumferential grooves 54*a* may be varied, depending upon the type and dimensions of the firearm for which the firearm safety lock kit 10 is configured for use, as the dimensions of the chamber insert 14 will so vary.

Figure 8:
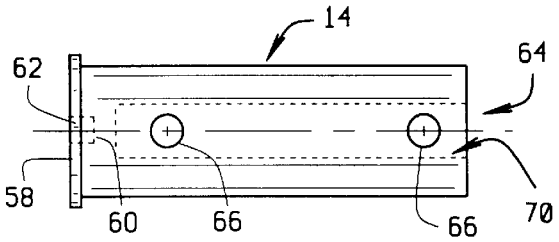
FIG. 8 is a side view of a chamber insert for use with the crimped look of FIG. 6.
Figure 9:
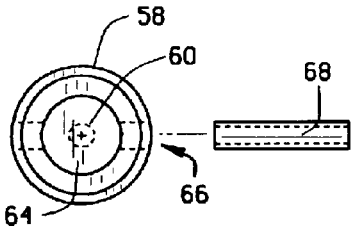
FIG. 9 is an end view of the chamber insert of FIG. 8, illustrating the placement of a locking pin.
Figure 11B:
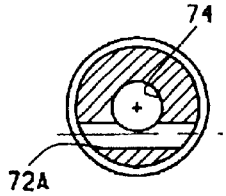
FIG. 11*b* is a first section view of the chamber insert of FIG.11*a,* illustrating the off-axis transverse bore and longitudinal bore relationships.

Turning next to FIG. 8 through FIG. 10, a first embodiment of the chamber insert 14 configured for use with the connecting cable 16 having a second end 44 forming a loop 46, as seen in FIG. 6, is shown. The chamber insert 14 has external dimensions corresponding to the dimensions of the ammunition utilized by the type of firearm for which the firearm safety lock kit 10 of the present invention is to be utilized. For example, as shown in FIG. 8, the chamber insert has external dimensions corresponding to a conventional 12-gauge shotgun shell, for use with conventional 12-gauge shotguns. At the base 58 of the chamber insert 14, and axial recess 60 is filled with a resilient material 62, such as natural or synthetic rubber, and is positioned to receive a firing pin or hammer from a firearm when the chamber insert is placed within the breech of the firearm. In this manner, the firing mechanism of the firearm may be released, or dry-fired, from any spring-loaded tension, permitting long-term storage thereof.

Opposite the base 58, a longitudinal axial bore 64 extends partially through the chamber insert 14, and is intersected by at least one transverse lock pin receiving bore 66. Each lock pin receiving bore 66 is configured to removably receive a lock pin 68. The lock pin 68 may be seated within the receiving bore 66 either by friction fit, or engaging threads (not shown).

Figure 10A:
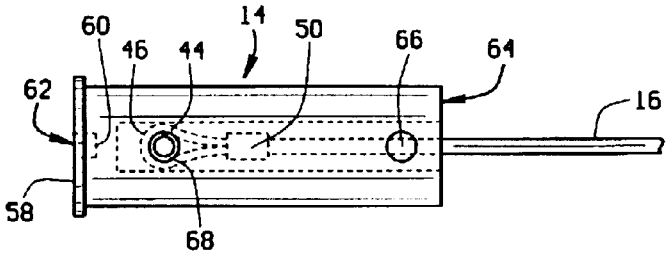
FIG. 10*a* is a view of the crimped cable loop of FIG. 6 secured in a first position in the chamber insert of FIG. 8.
Figure 11C:
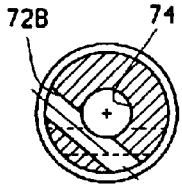
FIG. 11*c* is a second section view of the chamber inset of FIG. 11*a,* illustrating the relationship between two of the off-axis transverse bores and the longitudinal bore.
Figure 10B:
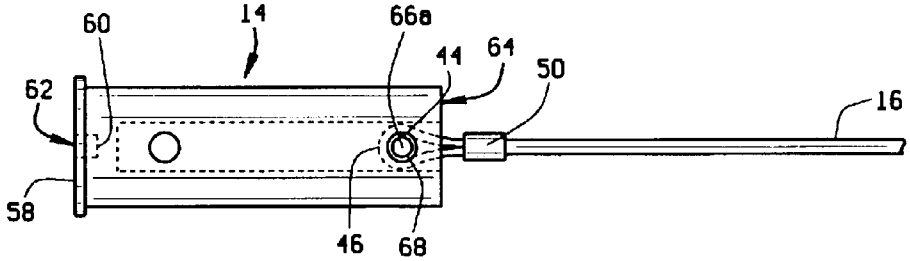
FIG. 10*b* is a view of the crimped cable loop of FIG. 6 secured in a second position in the chamber insert of FIG. 8.
Figure 11A:
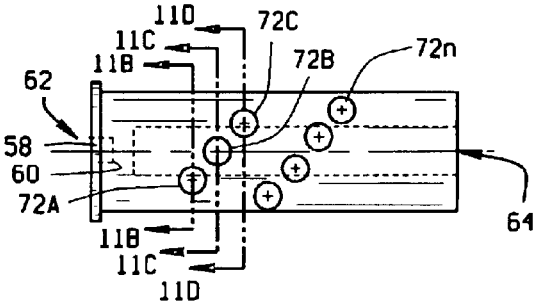
FIG. 11*a* is a side view of an alternate embodiment of the chamber insert for use with the second cylindrical locking rod of FIG. 7.
Figure 11D:
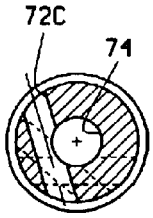
FIG. 11*d* is a third section view of the chamber insert of FIG. 11*a,* illustrating the relationship between three of the off-axis transverse bores and the longitudinal bore.

To secure the connecting cable 16 to the chamber insert 14, the loop 46 at the second end of the connecting cable 16 is inserted into the longitudinal axial bore 64 opposite the base 58. The loop 46 is positioned coaxially with the lock pin receiving bore 66, and the lock pin 68 inserted therein, as seen in FIG. 10*a*. The lock pin 68 passes through the coaxially positioned loop 46, and removably secures the connecting cable 16 to the chamber insert 14. In an alternative embodiment, a plurality of lock pin receiving bores 66–66*n*, where n is intended to designate any suitable number of bores, depending upon the length of the chamber insert 14, are formed in the chamber insert 14 at different longitudinal positions (FIG. 10*b*) along the axial bore 64, permitting the connecting cable 16 to be secured to the chamber insert 14 at different longitudinal positions, thereby adjusting the overall length of the firearm safety lock 10.

Turning next to FIG. 11*a* through FIG. 12*b*, an alternate embodiment of the chamber insert 14 configured for use with the connecting cable 16 having a second end 44 secured to the base of a second cylindrical locking rod 52, as seen in FIG. 7, is shown. Opposite the base 58, a reduced diameter axial bore 70 in the chamber insert 14 is sized axially and longitudinally to receive the length of the second cylindrical locking rod 52. The axial bore 70 is tangentially intersected by at least one off-axis transverse lock-pin bore 72*a*. As is seen in FIG. 11*b*, the longitudinal axis of the off-axis transverse lock-pin bore 72*a* is tangential to the inner surface 74 of the axial bore 70, such that the bores 70 and 72*a* intersect. In a second alternate embodiment, a plurality of off-axis transverse lock-pin bores 72*a*–72*n*, where n is intended to designate any suitable number of bores, depending upon the length of the chamber insert 14, are longitudinally spaced along the length of the chamber insert 14 axial bore 70. As is seen in FIGS. 11*a*–11*d*, the lock-pin bores 72*a*–72*c* may be spaced about the axial bore 70 in a spiral pattern, or other suitable pattern as is evident to those of ordinary skill in the art.

Figure 12B:
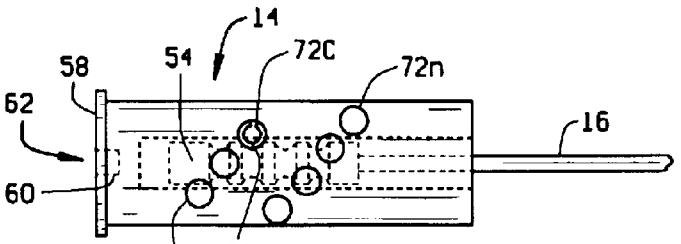
FIG. 12*b* is a view of the second locking rod of FIG. 7 secured in a second position in the chamber insert of FIG. 11*a.*
Figure 12A:
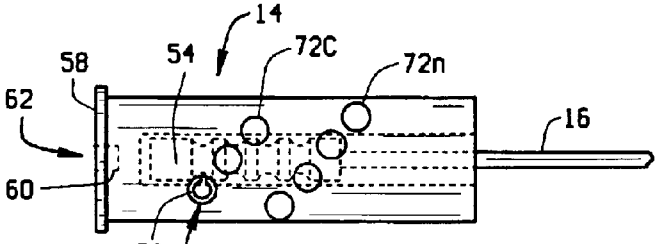
FIG. 12*a* is a view of the second locking rod of FIG. 7 secured in a first position in the chamber insert of FIG. 11*a.*

As seen in FIGS. 12*a* and 12*b*, to secure the connecting cable 16 to the chamber insert 14, the second cylindrical locking rod 52 is inserted into the axial bore 70 of the chamber insert, and a lock-pin 76 is driven through the off-axis transverse lock-pin bore 72*a*, engaging both the chamber insert 14 and the circumferential groove 54 in the locking rod 52. In this manner, the locking rod 52 is removably secured within chamber insert 14 by the lock-pin 76. In the alternate embodiments described above, the lock-pin 76 may be inserted in one of the lock pin bores 72*a*–72*n*, to engage the circumferential groove 54 at a different longitudinal position within the axial bore 70 of the chamber insert, thereby altering the overall length of the firearm safety lock 10, as is shown in FIG. 12*b*. Those of ordinary skill in the art will recognize that the overall length of the firearm safety lock 10 may be adjusted to a variety of lengths depending upon the number and placement of the lock-pin bores 72*a*–72*n* in the chamber insert 14, and upon the number and placement of the circumferential grooves 54 in the locking rod 52. Engagement of the lock-pin 76 with alternate circumferential grooves 54 in alternate lock-pin bores 72*a*–72*n* providing a plurality of overall lengths.

Figure 13:
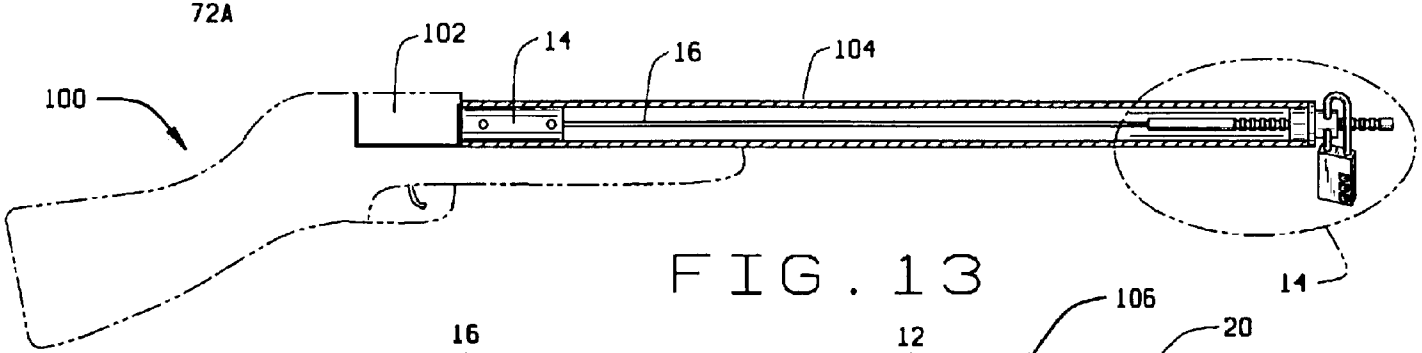
FIG. 13 is cut-away illustration of a conventional firearm with the components of the safety locking kit of the present invention secured therein.
Figure 14:
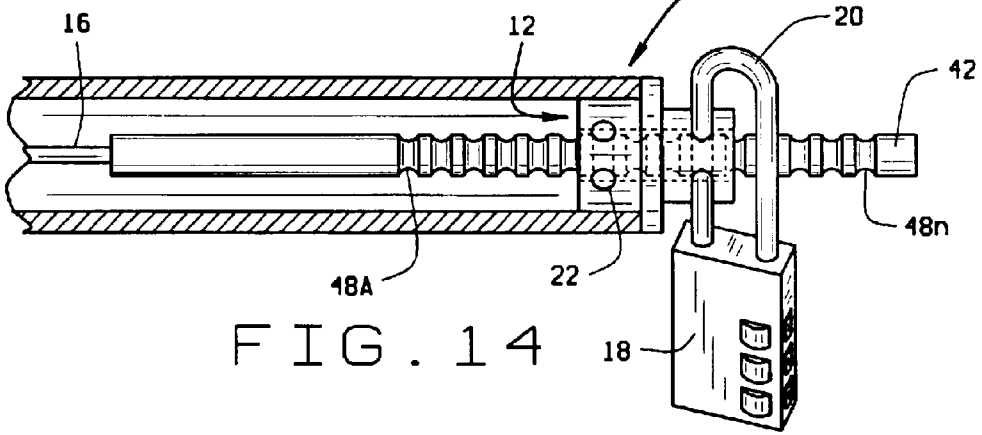
FIG. 14 is a enlargement of the firearm muzzle of FIG. 10, illustrating the securing of the muzzle insert to the first locking rod by the lock armature.

Turning next to FIGS. 13 and 14, the use of the firearm safety lock kit 10 is shown. Any conventional firearm 100, for example, a shotgun, having a single accessible breech area 102, a barrel 104, and a muzzle end 106 may be locked using the firearm safety lock kit 10 of the present invention. To lock the firearm 100, a firearm safety lock kit 10 having a chamber insert 14 with dimensions corresponding to the dimensions for the ammunition for the firearm 100 is selected. The connecting cable 16 is secured to the chamber insert 14, as described above, and the connecting cable 16 is passed into the barrel 104 through the breech area 102 of the firearm until the chamber insert 14 seats in the breech area 102. Optimally, when the connecting cable 16 is drawn through the barrel 104 under tension, a portion of the cylindrical locking rod 42 and at least one circumferential groove 48 extends beyond the muzzle end 106 of the firearm 100. The firearm safety lock kit 10 may be adjusted at the attachment point between the chamber insert 14 and the connecting cable 16 to adjust the length as is required to achieve the optimal extension of the cylindrical locking rod 42 beyond the muzzle end 106.

Next, the muzzle insert 12 is fitted over the cylindrical locking rod 42, such that the first cylindrical portion 22 seats within the barrel 104 and the circumferential flange 26 engages the muzzle end 106. Optimally, when the circumferential flange 26 engaged the muzzle end 106, the off-axis transverse lock receiving bore 30 in the second cylindrical portion 24 of the muzzle insert 12 is aligned with at least one circumferential groove 48 in the cylindrical locking rod 42. The firearm safety lock kit 10 may be adjusted at the attachment point between the chamber insert 14 and the connecting cable 16 to adjust the length as is required to align the off-axis transverse lock receiving bore 30 with the circumferential groove 48 when the muzzle insert 12 is seated in the muzzle end 106 of the barrel 104.

Optionally, the first cylindrical portion 22 may be slightly withdrawn from the barrel 104 to align the off-axis transverse lock receiving bore 30 with the circumferential groove 48.

Finally, as seen in FIG. 14, the armature 20 of a conventional lock 18 is passed through the off-axis transverse lock receiving bore 30 and returned to the lock 18, engaging the circumferential groove 48 in the cylindrical locking rod 42. The armature 20 prevents longitudinal movement of the muzzle insert 12 relative to the cylindrical locking rod 42. It will also be noted to those of ordinary skill in the art that the circumferential groove 48 into which the armature 20 is engaged will permit the lock 18 to swivel a full 360 degrees of rotation relative to the longitudinal axis of the firearm barrel. Furthermore, swiveling of the lock 18, the muzzle insert 12, or the locking rod 42 will not result in tightening or kink formation in the connecting cable 16, as the cable 16 and chamber insert 14 are both free to rotate about the longitudinal axis of the firearm barrel.

Removal of the firearm safety lock 10 from the firearm 100 is a reverse procedure. First, the conventional lock 18 is opened, then the armature removed from the off-axis transverse lock receiving bore 30, disengaging the muzzle insert 12 from the cylindrical locking rod 42. Once disengaged, the muzzle insert is readily removed from the muzzle end 106 of the firearm 100, and the chamber insert 14 withdrawn from the breech area 102. The connecting cable is pulled back through the firearm barrel 104 as the chamber insert 14 is withdrawn, and the firearm is available for use.

As best seen in FIG. 13, when the firearm safety kit 10 is utilized to lock the firearm 100, removal of the muzzle insert 12 from the muzzle end 106 of the firearm is prevented by the interaction between the armature 20, the cylindrical locking rod 42, the connecting cable 16, and the chamber insert 14, which cannot pass through the firearm barrel 104. Removal of the chamber insert 14 is similarly prevented by the muzzle insert 12. When secured through a firearm barrel 104 by the connecting cable 16, the chamber insert prevents the loading of ammunition into the breech area 102 of firearm 100, thereby precluding discharge thereof. The muzzle insert 12, secured in the muzzle end 106 by the cylindrical locking rod 42 is prevented from axial movement by the armature 20 of the lock 18, thereby preventing access to any portion of the connecting cable 16. Tampering with the exposed portion of the cylindrical locking rod 42 will not release the remaining portion of the locking rod 42 from engagement with the armature 20 within the muzzle insert 12. In this manner, once installed on the firearm 100, the firearm safety locking kit 10 of the present invention effectively prevents the loading and use of the firearm 100.

In view of the above, it will be seen that the several objects of the invention are achieved and other advantageous results are obtained. As various changes could be made in the above constructions without departing from the scope of the invention, it is intended that all matter contained in the above description or shown in the accompanying drawings shall be interpreted as illustrative and not in a limiting sense.

What is claimed is:

1. A firearm safety lock assembly in combination with a firearm having a muzzle disposed between a breech and an open end, comprising:

a cable having opposed first and second ends, and a rigid locking rod including at least one circumferential groove fixed at said second end of said cable;

a chamber insert sized to fit within a breech of a firearm, said chamber insert configured with a longitudinal bore, said first end of said cable removably secured within said longitudinal bore;

a muzzle insert having a first portion sized to seat within an open end of a firearm muzzle opposite said chamber insert, a second portion sized to extend beyond said open end of said firearm muzzle, and a circumferential flange with external diameter greater than an internal diameter of said muzzle located between said first and second portions, said muzzle insert further including an axial bore, and an off-axis transverse lock receiving bore in said second portion intersecting said axial bore; and a lock element having an armature configured to pass through said off-axis transverse lock receiving bore and said axial bore, said armature removably engaging said circumferential groove, securing said rigid locking rod to said muzzle insert such that said cable is secured through a firearm muzzle between said chamber insert and said muzzle insert.

2. The firearm safety lock assembly combination of claim 1 wherein a second rigid locking rod including at least one circumferential groove is fixed at said first end of said cable; and said chamber insert further includes an off-axis transverse bore intersecting said chamber insert longitudinal bore, said off-axis transverse bore sized to receive a lock pin;

wherein said second rigid locking rod seats within said chamber insert longitudinal bore such that said lock pin seated in said off-axis transverse bore engages said at least one circumferential groove, removably securing said first end of said cable within said longitudinal bore.

3. The firearm safety lock assembly combination of claim 2 wherein said second rigid locking rod includes a plurality of equidistantly spaced circumferential grooves arrayed from a first end to a cable attachment end of said second rigid locking rod; said chamber insert off-axis transverse bore located such that said lock pin engages a circumferential groove adjacent said cable attachment end when said second rigid locking rod is fully inserted within said chamber insert longitudinal bore, and engages a second circumferential groove adjacent said first end of said second rigid locking rod when said second rigid locking rod is partially inserted within said chamber insert longitudinal bore, thereby altering the distance between said chamber insert and said rigid locking rod.

4. The firearm safety lock assembly combination of claim 1 wherein said first end of said cable forms a closed loop; and said chamber insert further includes at least one cable attachment point within said longitudinal bore, said cable attachment point configured to removably secure said cable loop within said chamber insert longitudinal bore.

5. The firearm safety lock assembly combination of claim 4 wherein said chamber insert further includes a plurality of longitudinally displaced cable attachment points within said longitudinal bore.

6. The firearm safety lock assembly combination of claim 1 wherein said chamber insert has the same external dimensions as ammunition utilized by said firearm.

7. The firearm safety lock assembly combination of claim 1 wherein said chamber insert further includes a resilient firing pin receiver.

8. The firearm safety lock assembly combination of claim 1 wherein said first portion of said muzzle insert has a first external diameter sized to seat within an open end of a first firearm muzzle, and said second portion of said muzzle insert has a second external diameter sized to seat within an open end of a second firearm muzzle of differing caliber, said first portion of said muzzle insert further including a second off-axis transverse lock receiving bore such that said muzzle insert is longitudinally reversible for use in firearms of differing caliber.

9. The firearm safety lock assembly combination of claim 1 wherein said rigid locking rod includes a plurality of equidistantly spaced circumferential grooves, each of said circumferential grooves sized to receive a portion of said lock element armature.

10. A firearm safety lock assembly in combination with a firearm having a muzzle disposed between a breech and an open end, comprising:

a cable having opposed first and second ends, said first cable end having a first locking rod secured thereto, said second cable end having a second locking rod secured thereto;

a muzzle insert having an axial bore dimensioned to permit passage of said cable and said first locking rod, a co-axial first cylindrical portion sized for insertion within the muzzle of a firearm, a circumferential flange sized to prevent passage of said muzzle insert through said muzzle, and a second co-axial cylindrical portion opposite said first cylindrical portion, said second co-axial cylindrical portion including an off-axis transverse lock receiving bore intersecting said axial bore;

a chamber insert having an axial bore dimensioned to receive said second locking rod, end at least one cable-locking off-axis transverse bore intersecting said chamber axial bore;

a first cablelocking element configured for removable insertion within said at least one cable-locking off-axis transverse bore; and a second cable-locking element configured for removable insertion within said off-axis transverse lock receiving bore;

wherein said first cable-locking element engages a portion of said second locking rod, securing said second locking rod within said axial bore of said chamber insert, said cable passes through a muzzle of said firearm, and said second cablelocking element engages a portion of said first locking rod through said off-axis transverse lock receiving bore, securing said first locking rod within said axial bore of said muzzle insert.

11. A method for utilizing a firearm safety lock including a flexible tension member having opposed first and second ends, a locking rod including at least one circumferential groove secured to said second end of said flexible tension member; an insert sized to fit within a breech of a firearm; a muzzle insert having a first portion sized to seat within an open end of a firearm muzzle opposite said chamber insert, a second portion sized to extend beyond said open end of said firearm muzzle, and a shoulder with external diameter greater than an internal diameter of said muzzle located between said first and second portions, said muzzle insert further including an axial bore, and an off-axis transverse lock receiving bore in said second portion intersecting said axial bore; and a lock element having an armature configured to pass through said off-axis transverse lock receiving bore and said axial bore; comprising:

removably securing said first end of said flexible tension member to said insert;

inserting said locking rod and said flexible tension member into said firearm barrel though said firearm breech;

seating said insert within said firearm breech;

drawing said flexible tension member through said firearm barrel such that a portion of said locking rod protrudes beyond said firearm muzzle;

passing said protruding portion of said locking rod through said axial bore of said muzzle insert, such that said first portion of said muzzle insert seats within said firearm muzzle;

exerting force on said rigid cylindrical locking rod to draw said flexible tension member through said firearm barrel and said seated firearm muzzle insert, such that said circumferential groove in said locking rod aligns with said off-axis transverse lock receiving bore in said second portion of said muzzle insert; and inserting said lock element armature through said off-axis transverse lock receiving bore to engage said circumferential groove, thereby securing said flexible tension member between said insert and said muzzle insert.

* * * * *